US008408165B2

(12) United States Patent
Moffat et al.

(10) Patent No.: US 8,408,165 B2
(45) Date of Patent: Apr. 2, 2013

(54) COOLING SYSTEMS

(71) Applicant: Ford Global Technologies, LLC, Dearborn, MI (US)

(72) Inventors: John Moffat, Essex (GB); Chris James Leck, Middlesex (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/649,335

(22) Filed: Oct. 11, 2012

(65) Prior Publication Data

US 2013/0032102 A1 Feb. 7, 2013

Related U.S. Application Data

(62) Division of application No. 12/862,207, filed on Aug. 24, 2010, now Pat. No. 8,291,870.

(30) Foreign Application Priority Data

Nov. 5, 2009 (GB) ..... 0919393.9

(51) Int. Cl.
*F01P 7/02* (2006.01)

(52) U.S. Cl. ..... 123/41.05; 123/41.29

(58) Field of Classification Search ..... 123/41.05, 123/41.29, 41.09, 41.31, 196 R, 196 AB
See application file for complete search history.

(56) References Cited

U.S. PATENT DOCUMENTS

| | | | | |
|---|---|---|---|---|
| 4,930,455 | A | 6/1990 | Creed et al. | |
| 5,215,044 | A | 6/1993 | Banzhaf et al. | |
| 5,619,957 | A | 4/1997 | Michels | |
| 5,701,852 | A | 12/1997 | Suzuki et al. | |
| 6,178,928 | B1 * | 1/2001 | Corriveau | 123/41.12 |
| 6,273,033 | B1 | 8/2001 | Enander et al. | |
| 6,539,899 | B1 | 4/2003 | Piccirilli et al. | |
| 6,601,545 | B1 | 8/2003 | Hohl | |
| 6,668,764 | B1 | 12/2003 | Henderson et al. | |
| 6,758,172 | B2 | 7/2004 | Morgan et al. | |
| 6,776,126 | B2 | 8/2004 | Le Lievre et al. | |
| 7,237,513 | B2 | 7/2007 | Pfeffinger et al. | |

FOREIGN PATENT DOCUMENTS

| | | | |
|---|---|---|---|
| DE | 10316017 | A1 | 10/2004 |
| DE | 102004058865 | A1 | 6/2006 |
| DE | 102005056717 | A1 | 5/2007 |
| EP | 0670414 | A1 | 9/1995 |
| EP | 1529937 | A1 | 5/2005 |
| GB | 2366365 | A | 3/2002 |
| GB | 2401167 | A | 11/2004 |
| GB | 2420847 | A | 6/2006 |

OTHER PUBLICATIONS

German Search Report dated Feb. 9, 2012.
GB Search Report dated Feb. 4, 2010, pp. 1-2.

* cited by examiner

*Primary Examiner* — Noah Kamen
*Assistant Examiner* — Hung Q Nguyen
(74) *Attorney, Agent, or Firm* — Julia Voutyras; Brooks Kushman P.C.

(57) ABSTRACT

A method for controlling a cooling system for a vehicle having an internal combustion engine permits rapid warm-up of the engine by the use of two electrically-operated valves in addition to a conventional thermostat. The method includes controlling a bypass valve and a heater valve to both remain closed at low coolant temperatures and engine speed to inhibit coolant flow through the engine. A control unit opens the bypass valve to prevent cavitation in the water pump if engine speed and/or load exceeds a certain value. The heater valve is opened when a threshold engine coolant temperature is reached permitting warming of the heater matrix.

12 Claims, 2 Drawing Sheets

COOLING SYSTEMS

CROSS-REFERENCE TO RELATED APPLICATIONS

This application is a division of U.S. application Ser. No. 12/862,207 filed Aug. 24, 2010, (now U.S. Pat. No. 8,291,870 issued Oct. 23, 2012) which, in turn, claims foreign priority benefits under 35 U.S.C. §119(a)-(d) to GB 0919393.9 filed Nov. 5, 2009, the disclosures of which are hereby incorporated by reference in their entirety.

TECHNICAL FIELD

This disclosure relates to cooling systems for a motor vehicle having an internal combustion engine.

BACKGROUND

As internal combustion engines become more fuel efficient, less waste heat is produced and consequently, the time taken to reach an optimum running temperature increases. This protracted time has a deleterious effect on fuel economy and engine wear.

Hence, a cooling system which reduces the time taken for a cold engine to reach its optimum running temperature would be desirable.

SUMMARY

Accordingly, in a first embodiment, the present disclosure comprises a cooling system for a motor vehicle having an internal combustion engine, said cooling system including a pump for supplying coolant to the engine, an outflow conduit for connecting the pump outlet to the engine, and a return circuit for connecting the engine to the pump inlet, wherein the return circuit comprises three branches, a first branch including a first valve, a second branch including a radiator and thermostat, and a third branch including a heater matrix, a degas tank and a second valve.

The second branch of the return circuit may further include an engine oil cooler.

The first and second valves may be controlled electronically, and the cooling system includes a control unit for controlling the valves in response to an input from at least one of the following onboard vehicle devices; an engine coolant temperature sensor, an ambient air temperature sensor, a timer, a cabin heating demand sensor, an engine operating condition sensor.

The engine operating condition sensor may be, for example, a sensor which detects engine speed, engine load, throttle position, or mass air flow into the engine.

To prevent damage to the pump if malfunction of the control unit were to occur, the first valve has its default position set to the closed position and the second valve has its default position set to the open position.

In accordance with a second embodiment, the present disclosure includes a method of operating a cooling system for a motor vehicle having an internal combustion engine, wherein the cooling system includes a pump for supplying coolant to the engine, an outflow conduit for connecting the pump outlet to the engine, and a return circuit for connecting the engine to the pump inlet, the return circuit comprising three branches, a first branch including a first valve, a second branch including a radiator and thermostat, and a third branch including a heater matrix, a degas tank and a second valve. The method includes: opening both first and second valves for a period long enough to flush air from the system when the engine is started cold. Then, both valves are closed. At least one engine operating condition and engine coolant temperature are monitored. The first valve is closed if one engine operating condition exceeds a pre-set level; and the second valve is opened if engine coolant temperature exceeds a threshold value.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations consistent with the present disclosure, e.g., ones in which components are arranged in a slightly different order than shown in the embodiments in the Figures. Those of ordinary skill in the art will recognize that the teachings of the present disclosure may be applied to other applications or implementations.

Figure 1:
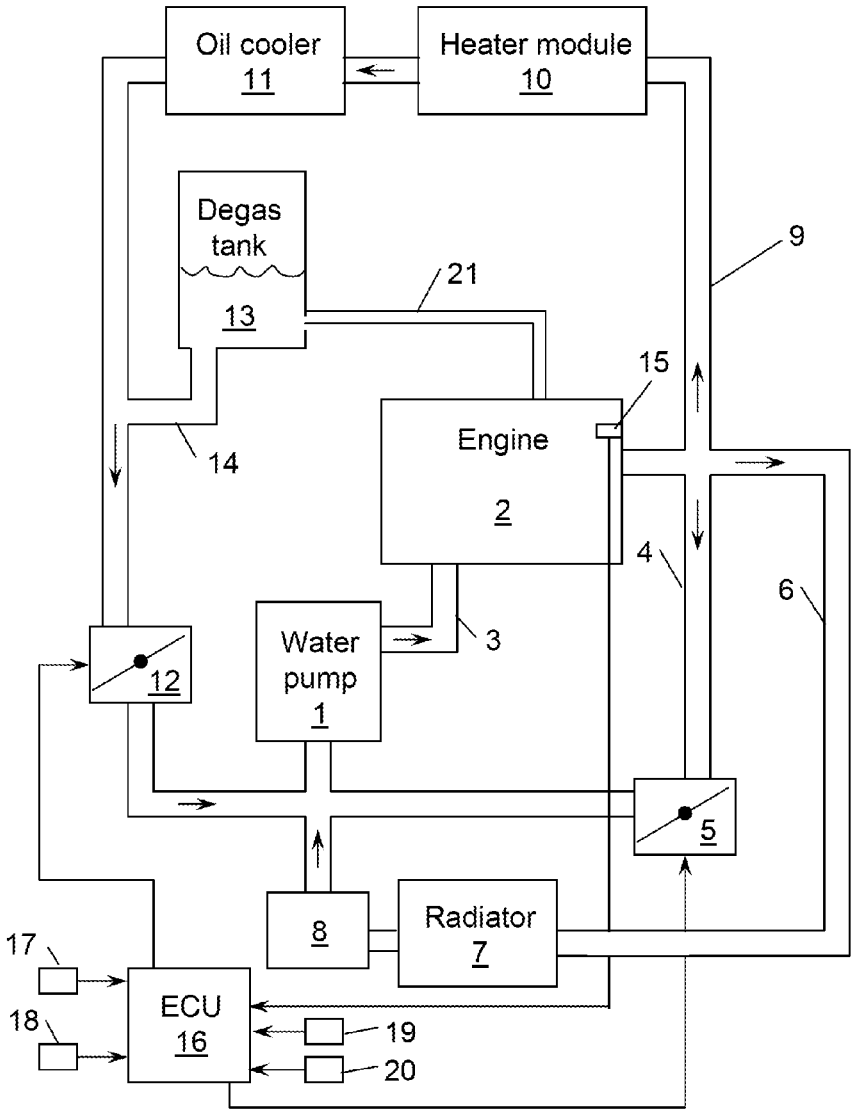
FIG. 1 is a schematic block diagram of a cooling system in accordance with a preferred embodiment of the disclosure.

With reference to FIG. 1, a water pump 1 supplies coolant to an internal combustion engine 2 via a conduit 3 which connects the pump outlet to the engine 2.

Coolant returns to the inlet side of the pump 2 via a return circuit which comprises three branches. A first branch 4 includes an electronically controllable bypass valve 5. A second branch 6 includes a radiator 7 and thermostat 8. A third branch 9 includes a heater matrix 10, an engine oil cooler 11 and electronically—controllable heater/degas valve 12 and a degas tank 13 connected via a side branch 14 upstream of the heater/degas valve 12 and downstream of the oil cooler 11 and heater matrix 10.

A temperature sensor 15 is provided on the engine 2 for monitoring the temperature of the coolant at the point at which it leaves the engine 2.

An electronic control unit (ECU) 16 is electrically connected with the bypass valve 5 and the heater/degas valve 12 and controls opening and closing of each valve 5, 12. The ECU 16 receives inputs from a timer 17, an ambient air temperature sensor 18, an engine speed sensor 19 and a cabin heater demand sensor 20. A conduit 21 links the engine 2 directly with the degas tank 13. Alternatively engine speed sensor 19 may be an engine load sensor, a throttle position sensor, or a mass airflow sensor.

Figure 2:
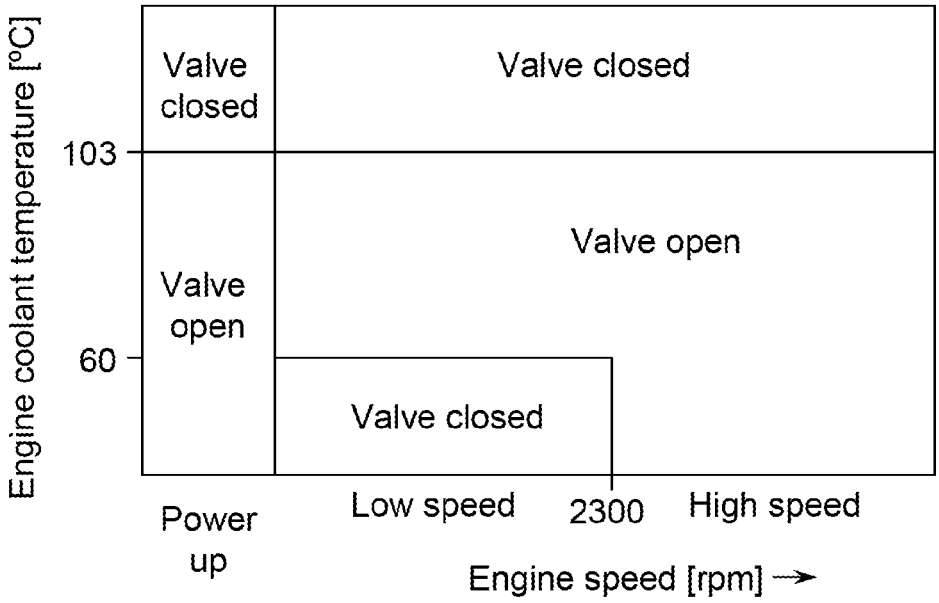
FIG. 2 is a chart illustrating an operating regime of a first valve which is included in the system of FIG. 1.
Figure 3:
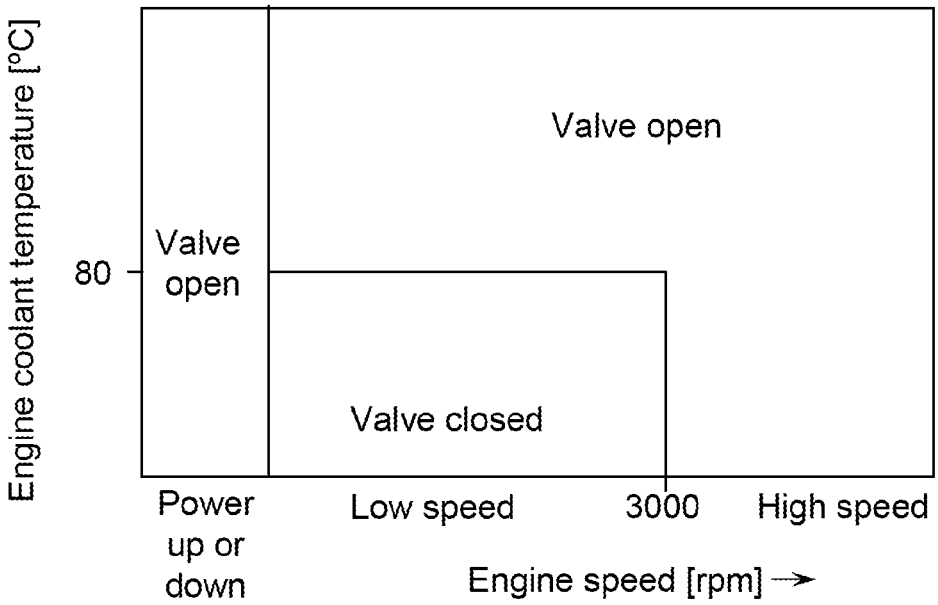
FIG. 3 is a chart illustrating an operating regime of a second value which is included in the system of FIG. 1.

Operation of the system of FIG. 1 is described with particular reference to FIGS. 2 and 3 in which FIG. 2 shows operation of valve 5, a first valve, and FIG. 3 shows operation of valve 12, a second valve, according to one example embodiment. The specific ranges in speed and temperature shown in the table and the numbers provided herein are non-limiting and merely serve to provide one example.

During operation, the ECU 16 constantly monitors engine coolant temperature, engine speed, ambient air temperature and cabin heat demand (as requested by the occupants of the vehicle) and is also responsive to a signal from the timer 17. In response to these various inputs, the ECU 16 opens or closes each of the valves 5, 12 in accordance with a pre-set operating regime.

For a few seconds immediately following a cold start of the engine 2, both valves 5, 12 are opened. This measure serves to flush out air that might be in the system. After ten seconds (in this example) have elapsed, as measured by the timer 17, both valves are closed. Provided that engine speed remains relatively low, both valves 5, 12 remain closed. With both valves 5, 12 closed and the thermostat 8 also closed, there is virtually no circulation of coolant through the engine 2 and so the engine warms up quickly. However, if engine speed reaches a threshold value, say 2300 rpm in this example, then the bypass valve 5 is opened to prevent cavitation occurring in the pump 1. If the engine speed continues to increase, say beyond 3000 rpm them the heater/degas valve 12 is also opened to ensure that no pump damage can occur.

If engine rpm remains within the lower limit, then both valves 5, 12 remain closed until the engine coolant temperature reaches an intermediate (medium) value, say 60 degrees Celsius, whereupon the bypass valve 5 is opened. This allows some coolant flow through the engine while the thermostat 8 remains shut.

The heater/degas valve remains closed until engine coolant temperature rises further to around 80 degrees Celsius, say, unless ambient air temperature is very low or the occupants demand some cabin heating in which case it is opened sooner.

Throughout the engine coolant temperature range from around 80 degrees Celsius to the point at which the thermostat opens, say 103 degrees Celsius, both valves 5, 12 are open, irrespective of engine speed. Hence (warm) coolant is supplied to the heater matrix and to the oil cooler for warming the cabin of the vehicle and for maintaining engine oil at an optimum temperature.

Once this threshold temperature of 103 degrees Celsius is exceeded and the thermostat 8 is open, the bypass valve 5 is closed allowing full flow of coolant through the radiator 7.

If the engine 2 is switched off and the restarted when still hot, the bypass valve 5 is closed and the heater/degas valve is opened.

The default (unpowered) position of the bypass valve 5 is closed and the default (unpowered) position of the heater/degas valve 12 is open. Hence if the ECU 16 fails, the valves 5, 12 allow coolant to flow such that no damage to the pump 1 or a hot engine 2 can occur.

While the best mode has been described in detail, those familiar with the art will recognize various alternative designs and embodiments within the scope of the following claims. Where one or more embodiments have been described as providing advantages or being preferred over other embodiments and/or over prior art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the disclosure as claimed.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of operating a cooling system for a motor vehicle having an internal combustion engine wherein the cooling system includes a pump for supplying coolant to the engine, an outflow conduit for connecting the pump outlet to the engine, and a return circuit for connecting the engine to the pump inlet, the return circuit comprising three branches, a first branch including a first valve, a second branch including a radiator and thermostat, and a third branch including a heater matrix a degas tank and a second valve, the method including;

monitoring at least one engine operating condition and engine coolant temperature;

opening the first valve if the at least one engine operating condition exceeds a threshold level; and opening the second valve if engine coolant temperature exceeds a first threshold temperature.

2. The method of claim 1 wherein the engine operating condition is one of engine speed, engine load, throttle position, and mass airflow.

3. The method of claim 1, further comprising:

closing the first valve if the engine coolant temperature exceeds a second threshold.

4. The method of claim 1, further comprising:

opening both the first and second valves for a predetermined period upon starting the engine from cold; and closing both valves after said period has elapsed.

5. A method for operating a cooling system in a vehicle having an engine, and a cooling circuit connected to the engine and including a first branch having a first valve, a second branch having a radiator and a thermostat, and a third branch having a heater matrix, a degas tank, and a second valve, comprising:

executing instructions using an electronic control unit electronically coupled to the first valve and the second valve to open the first and second valves for a predetermined period after the engine is started and then close the first and second valves.

6. The method of claim 5 wherein the cooling system further includes a pump for supplying coolant to the engine wherein the pump is located upstream of the engine and the three branches are located downstream of the engine.

7. The method of claim 5 wherein the system includes an engine speed sensor electronically coupled to the electronic control unit and a temperature sensor disposed in the engine and electronically coupled to the electronic control unit, the method further comprising:

closing the first valve when engine coolant temperature exceeds a threshold temperature.

8. The method of claim 5 wherein the system includes a a coolant pump, an outflow conduit connecting a coolant pump outlet to the engine, and a return circuit connecting the engine to a coolant pump inlet, the method comprising:

opening the first and second valves for a period to flush air from the system air from the system after a cold start; and closing the first and second valves after the period.

9. The method of claim 5 wherein the third branch of the return circuit further includes an engine oil cooler, the method further comprising:

electronically controlling the first and second valves in response to an input from at least one of the following onboard vehicle devices: an engine coolant temperature sensor, an ambient air temperature sensor, a timer, a cabin heating demand sensor, and an engine operating condition sensor.

10. A method for controlling an engine having a cooling circuit connected to the engine with a first branch including a first valve, a second branch including a radiator and a thermostat, and a third branch including a heater matrix, a degas tank, and a second valve, the method comprising electronically controlling the first and second valves to open for a predetermined period after the engine is started.

11. The method of claim 10 wherein the cooling system includes a temperature sensor coupled to an electronic controller, the method further comprising:

closing the first valve when engine coolant temperature exceeds an associated threshold.

12. The method of claim 11 further comprising:

opening the second valve when the engine coolant temperature exceeds an associated threshold.

* * * * *